United States Patent [19]

Stamp

[11] Patent Number: 4,562,996

[45] Date of Patent: Jan. 7, 1986

[54] APPARATUS FOR MELTING METAL

[76] Inventor: Thomas B. Stamp, "Laurentides", Haymes Rd., Cleeve Hill, Cheltenham, Gloucestershire, United Kingdom

[21] Appl. No.: 531,652

[22] Filed: Sep. 13, 1983

[51] Int. Cl.[4] ..... F27B 5/14

[52] U.S. Cl. ..... 266/242; 266/901; 432/209

[58] Field of Search ..... 266/242, 900, 901; 75/65 R, 77; 432/209, 212; 239/135, 283; 431/154, 285; 110/163

[56] References Cited

U.S. PATENT DOCUMENTS

| | | | |
|---|---|---|---|
| 814,769 | 3/1906 | Cline | 266/242 |
| 1,865,295 | 6/1932 | Arper | 110/163 |
| 1,912,288 | 5/1933 | Lundt et al. | 432/209 |
| 2,025,687 | 12/1935 | Kemp | 432/209 |
| 2,137,693 | 12/1938 | Lundt | 432/209 |
| 2,271,168 | 1/1942 | Booth | 266/900 |
| 3,115,421 | 12/1963 | Seymour | 266/900 |
| 3,910,749 | 10/1975 | Voorheis | 431/285 |
| 4,353,532 | 10/1982 | Jay | 266/242 |

OTHER PUBLICATIONS

Newton, "Extractive Metallurgy", Wiley and Sons, 1959, pp. 408–409.

"The Making, Shaping and Treating of Steel, " United States Steel, 1971, p. 505.

*Primary Examiner*—L. Dewayne Rutledge
*Assistant Examiner*—Robert L. McDowell
*Attorney, Agent, or Firm*—Young & Thompson

[57] ABSTRACT

This invention relates to apparatus for melting metal, and particularly for melting lead. The apparatus 10 comprises a reservoir 11, a heat exchange tube 12, which extends through the reservoir, a burner nozzle 13 at the inlet 14 of the tube and a flue 15 at the outlet 16 of the tube 12. Heating of air in the tube induces a draught through the tube and up the flue 15, so that air is drawn into the tube at the inlet 14. This flow of air causes the flame from the burner nozzle 13 to be sucked downwardly into the tube. The tube, and hence lead surrounding it, is thus heated.

6 Claims, 3 Drawing Figures

APPARATUS FOR MELTING METAL

This invention relates to apparatus for melting metal and in particular, but not exclusively, for apparatus for melting lead for use in automatic casting machines.

Various systems exist for melting lead in relatively large quantities for automatic casting machines. The most common is to place the lead pot or reservoir inside a furnace so that the lead is melted by flames impinging on the outside of the reservoir. This is extremely inefficient because the bulk of the lead does not lie adjacent the heated walls and further the thermal gradient from the flames to the outside is so great that the heat loss is considerable even given the substantial lagging which is necessary for safety purposes.

At least in other fields it has of course been proposed to heat the material in a reservoir by means of horizontal fire tubes passing through the reservoir from a burner or furnace disposed at its side. This system is not really practical for use in a lead pot or reservoir, because, of necessity, the welded joints between the fire tubes and the reservoir walls would lie beneath the lead level and hence be subjected to very considerable forces when the lead contracted at the end of an operating cycle.

It is an object of the present invention to provide an improved apparatus for heating metal which overcomes or reduces one or more of the above mentioned problems.

From one aspect the invention consists in apparatus for melting metal comprising a reservoir for the metal, a heat exchange tube extending through the reservoir and defining an inlet and an outlet above the level of metal in the reservoir, a burner having a nozzle, means for mounting the burner at the inlet so that the nozzle is directed into the inlet, a flue attached to the outlet, the inlet communicating with the surrounding atmosphere whereby air heated by the burner passing up the flue causes air, and hence the burner flame, to be induced into the tube to heat the metal.

In a preferred embodiment the heat exchange tube leaves the reservoir through the top thereof and the nozzle is mounted concentrically with the tube. It is further preferred that either the flue extends to a height of 1.5 to 2.5 meters above the inlet, for example approximately 2 meters above the inlet or that there is a draught break within that height range. This is to ensure that the suction of air into the heat exchange tube is not so great as to blow the burner flame out.

The flue may be at least partially lagged as may be the reservoir. The mounting means may comprise a collar mountable on the inlet and at least a pair of spaced upstanding arms for supporting the nozzle.

The apparatus may further comprise a pre-burner for heating the air in the tube prior to ignition of the burner. The burner nozzle may be suitable for burning natural gas, town gas or liquid petroleum gas or any other suitable fuel.

From another aspect the invention consists in immersion heating apparatus comprising a reservoir for material to be heated, a heat exchange tube extending through the reservoir to define an inlet and an outlet adjacent to or above the top of the reservoir, a burner, means for mounting the burner on the inlet so that it is directed into the inlet and means for sucking the flame of the burner into the tube so that the burner burns substantially downwardly.

The invention may be performed in various ways and a specific embodiment will now be described, by way of example, with modifications, with reference to the accompanying drawings in which.

Figure 1:
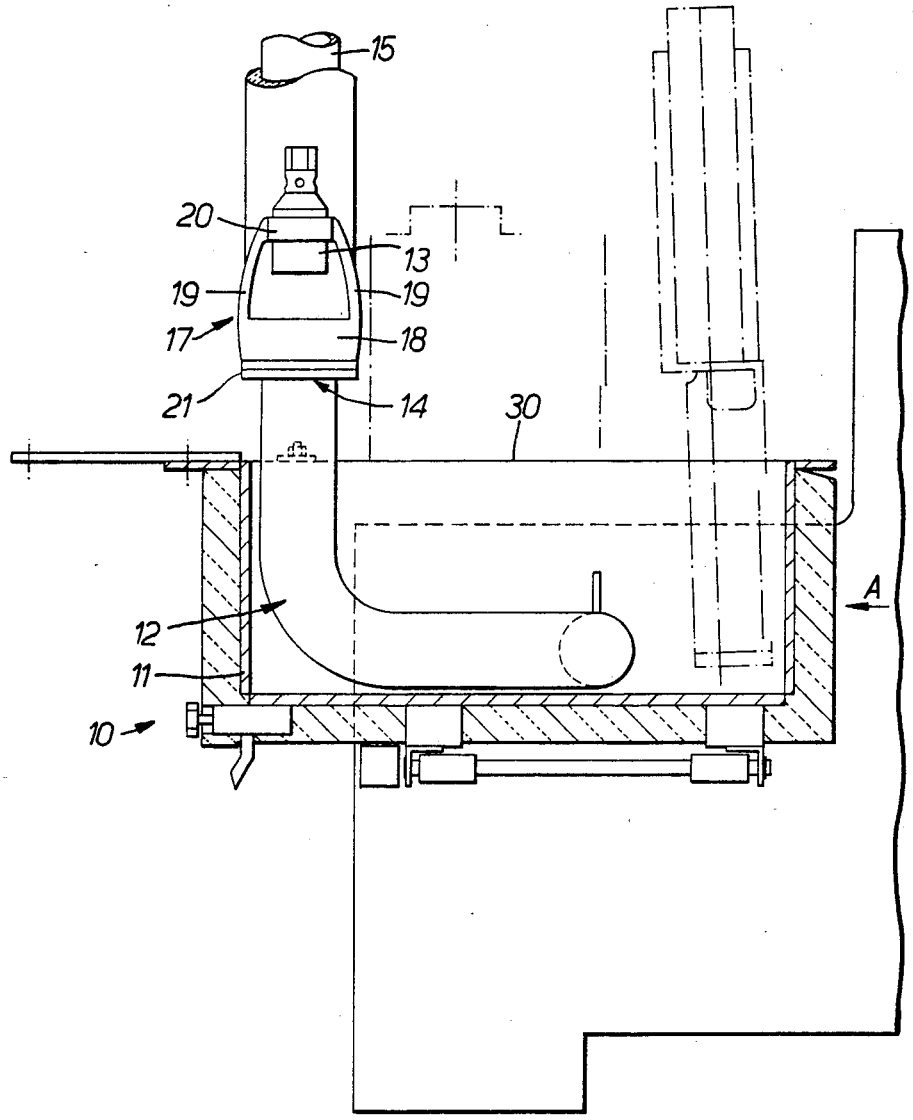
FIG. 1 is a partial sectional view of apparatus for heating metal.
Figure 2:
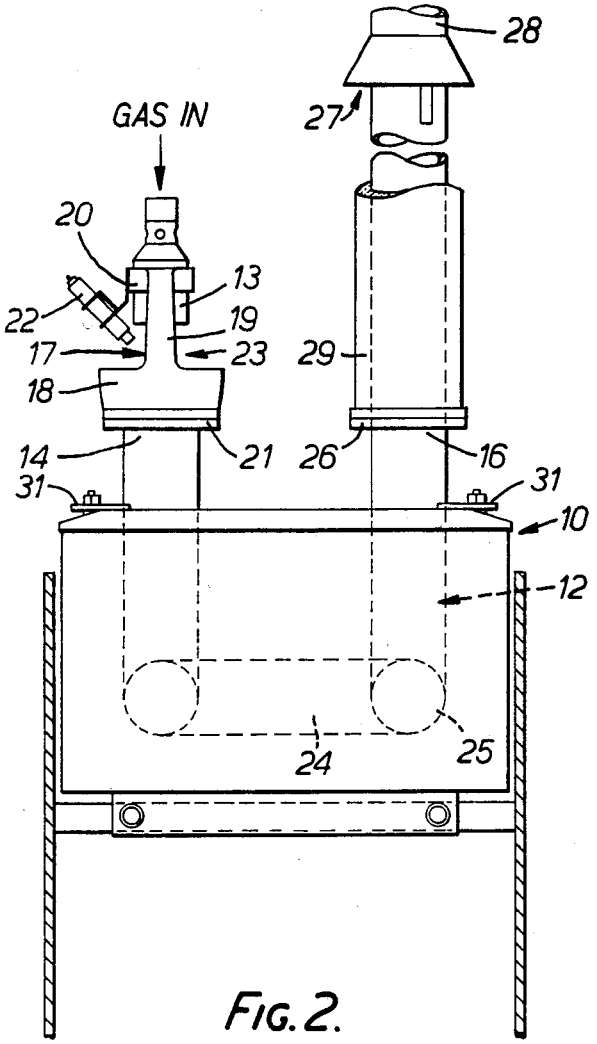
FIG. 2 is an end view on the arrow A.

As can be seen in FIGS. 1 and 2 apparatus for melting metal, and particularly lead, is generally indicated at 10 and comprises a reservoir 11, a heat exchange tube 12, which extends through the reservoir, a burner nozzle 13 at the inlet 14 of the tube and a flue 15 at the outlet 16 of the tube 12.

The burner nozzle 13 is located on the inlet 14 by means of a mounting 17 which comprises a collar 18 and a pair of upstanding arms 19 which support an annular seat 20. The inlet 14 is formed with an accurately cast and machined flange 21 which receives an equally accurately formed collar 18 so that the nozzle 13 is positioned concentrically with the tube 12. It will be appreciated that in this position the nozzle is directed downwardly into the tube 12. A pre-ignition or pre-heating burner or pilot light 22 is supported on the mounting 17 and is directed into the space 23 between the nozzle 13 and the inlet 14.

The tube extends downwardly into the reservoir and then along the bottom of the reservoir longitudinally to a lateral portion 24 which then merges into a further longitudinal portion 25 which passes back down the reservoir up to the outlet 16. The tube is shown as having a plain surface but may be profiled with fins, ribs or other formations for improving heat exchange.

The flue 15 is attached to the outlet 16 by an annular flange 26 and extends upwardly therefrom. Preferably, for reasons set out below, the flue is about 2 meters in length and is connected to a chimney in the roof by means of a draught break 27 and a flue extension 28. The lower portion of the flue is lagged at 29.

In use, lead to be melted is placed in the reservoir 11 to surround the tube 12. The pre-ignition burner 22 is then ignited to heat the air in the tube. As is well known air becomes lighter when heated and it therefore passes up the flue 15 setting up a partial vacuum in the tube 12 which induces a flow of outside air into the space 23 and down into the tube 12. When this air current is established the main burner nozzle 13 is ignited and the flame from that nozzle is sucked down into the tube by the air draught. The flame further heats the air in the tube increasing the draught and also rapidly heats the tube 12. It has been found that if the flue 15 is coupled directly into a roof chimney the draught created in the tube 12 is far too great and may even blow out the flame from the nozzle 13. It is for this reason that the draught break 27 is introduced to provide a limit to the air draught. The lagging 29 on the flue 15 reduces the initial heat loss from the flue and hence speeds up the start up time of the apparatus.

The apparatus is then run for as long as is required by the user and then the burner nozzle 13 is switched off. Because the tube 12 enters and leaves the reservoir through its top 30, and hence well above the lead level, there is no need for a welded joint nor is there any risk of leakage through a damaged joint. Instead the tube is simply held by releasable detents 31. Because the flame from the nozzle is sucked into the tube which is positioned within the lead the heat from the flame must pass through the lead before any heat loss can occur and therefore the system is very much more efficient than prior art air systems and considerably less lagging is needed for the reservoir 11.

Figure 3:
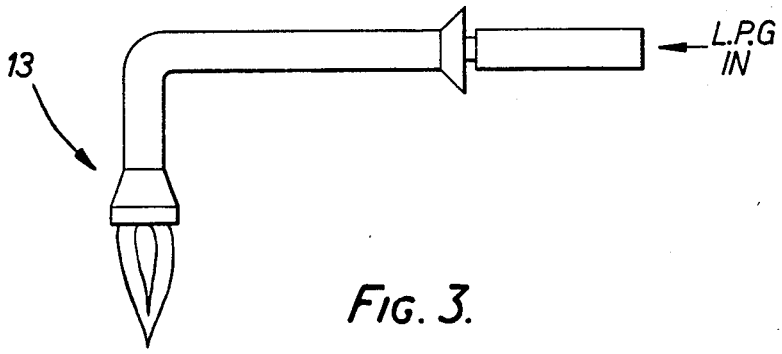
FIG. 3 is a view of a liquid petroleum gas nozzle for use with the apparatus.

The nozzle illustrated in FIGS. 1 and 2 is suitable for natural gas. A liquid petroleum gas nozzle is illustrated in FIG. 3.

I claim:

1. Apparatus for melting metal, comprising a reservoir for metal, an integral one-piece heat exchange tube defining an inlet and an outlet above the level of metal in the reservoir, the tube extending from the inlet down into the reservoir around a generally U-shaped path and up to the outlet, a burner having a nozzle, means for mounting the burner above the inlet, and a flue attached to the outlet and extending above the reservoir a substantial distance such that air heated by the burner passing up the flue creates a natural draft that causes air from the surrounding atmosphere and hence the burner flame, to be induced into and along the tube to heat the metal.

2. Apparatus as claimed in claim 1, and a draft break intermediate the length of said flue.

3. Apparatus as claimed in claim 2, said draft break being at a height of 1.5 to 2.5 meters above the inlet.

4. Apparatus as claimed in claim 2, said draft break being at a height of about 2 meters above the inlet.

5. Apparatus as claimed in claim 1, and a pre-burner for heating the air in the tube prior to ignition of the burner thereby to establish said natural draft in said flue prior to ignition of the burner.

6. Apparatus for melting lead for use with a lead casting machine, comprising a reservoir for lead, an integral one-piece heat exchange tube defining an inlet and an outlet above the level of metal in the reservoir, the tube extending from the inlet down into the reservoir around a generally U-shaped path and up to the outlet such that the inlet and outlet are generally adjacent a burner having a nozzle, means for mounting the burner above the inlet, including a first collar for receiving the burner, a second collar for receiving the inlet and at least a pair of arms supporting the first collar on the second, a flue attached to the outlet and including a draft break, the arms of the mounting means defining open windows around the inelt to communicate it with the surrounding atmosphere whereby air heated by the burner passing up the flue causes air from the surrounding atmosphere and hence the burner flame, to be induced into and along the tube to heat the lead, without creating hot spots in the tube.

* * * * *